US008582795B2

(12) United States Patent
Miles et al.

(10) Patent No.: US 8,582,795 B2
(45) Date of Patent: Nov. 12, 2013

(54) ROBUST DIAPHRAGM FOR AN ACOUSTIC DEVICE

(75) Inventors: Ronald N. Miles, Newark Valley, NY (US); Weili Cui, Endicott, NY (US)

(73) Assignee: The Research Foundation of State University of New York, Binghamton, NY (US)

( * ) Notice: Subject to any disclaimer, the term of this patent is extended or adjusted under 35 U.S.C. 154(b) by 198 days.

(21) Appl. No.: 13/013,812

(22) Filed: Jan. 25, 2011

(65) Prior Publication Data

US 2012/0189151 A1 Jul. 26, 2012

Related U.S. Application Data

(63) Continuation of application No. 10/689,189, filed on Oct. 20, 2003, now Pat. No. 7,876,924.

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/00*** | (2006.01) |
| ***H04R 9/06*** | (2006.01) |
| ***H04R 11/02*** | (2006.01) |

(52) U.S. Cl.
USPC ..... 381/361; 381/423

(58) Field of Classification Search
USPC ..... 381/361, 423, 355, 170–181
See application file for complete search history.

(56) References Cited

U.S. PATENT DOCUMENTS

| | | | | |
|---|---|---|---|---|
| 5,161,200 | A * | 11/1992 | Barr | 381/173 |
| 5,870,482 | A * | 2/1999 | Loeppert et al. | 381/174 |
| 6,535,460 | B2 * | 3/2003 | Loeppert et al. | 367/181 |
| 7,545,945 | B2 * | 6/2009 | Miles | 381/174 |
| 8,121,315 | B2 * | 2/2012 | Song et al. | 381/174 |

* cited by examiner

*Primary Examiner* — Curtis Kuntz
*Assistant Examiner* — David J Ho
(74) *Attorney, Agent, or Firm* — Steven M. Hoffberg; Ostrolenk Faber LLP

(57) ABSTRACT

A rigid, flat plate diaphragm for an acoustic device is illustrated. The internal supporting structure of the diaphragm provides a combination of torsional and translational stiffeners, which resemble a number of crossbars. These stiffeners brace and support the diaphragm motion, thus causing its response to not be adversely affected by fabrication stresses and causing it to be very similar in dynamic response to an ideal flat plate operating in a frequency range that extends well beyond the audible.

20 Claims, 2 Drawing Sheets

ROBUST DIAPHRAGM FOR AN ACOUSTIC DEVICE

FIELD OF THE INVENTION

The present invention relates to acoustic devices such as microphones and hearing aids and, more particularly, to an improved diaphragm for a microphone having a robust dynamic response in a frequency range extending well past the audible.

BACKGROUND OF THE INVENTION

Fabrication of substantially flat, compliant diaphragms is essential to the success of sensitive microphones. A significant obstacle to achieving this goal is the inevitable residual stresses induced during the process of manufacturing miniature microphone diaphragms. The thickness of miniature microphone diaphragms is typically on the order of microns. Stresses in such thin films can result in warpage or buckling, or can lead to breakage. Much effort has been put into controlling the flatness and dynamic performance of thin film diaphragms.

One common method to prevent the aforementioned warpage is to clamp all four edges or all four corners of a thin diaphragm and utilize tensile stress to control the flatness. The tension, however, increases the stiffness of the diaphragm and consequently decreases the sensitivity of the microphone. The inability to accurately control the tensile stress during fabrication also leads to unpredictable dynamic characteristics for the microphone.

To achieve an acceptable sensitivity, a microphone diaphragm needs to be very compliant. The cantilever structure described in this invention is an alternative to conventional four-edge (or four-corner) clamped devices. The new cantilever design seeks to achieve a sensitive microphone, since cantilever diaphragms are much more compliant than tensioned diaphragms.

One of the objects of the present invention is to provide a robust microphone diaphragm design that maintains good dimensional control under the influences of residual stresses, either compressive or tensile, while having its dynamic response dominated only by a single mode of vibration. The response of the diaphragm is predicted to be extremely close to that of an ideal rigid plate over a frequency range extending well beyond the audible range.

The internal supporting structure of this diaphragm provides a combination of torsional and translational stiffeners that resemble a number of crossbars. These stiffeners brace and support the diaphragm motion, thus causing it to be very similar in dynamic response to an ideal flat plate operating in a frequency range extending well beyond the audible. The diaphragm is essentially constrained to pivot about an edge upon which it is supported. The supported end has an overlapping T-section whose length and cross-sectional dimensions can be adjusted to tune the resonant frequency.

DISCUSSION OF RELATED ART

In U.S. Pat. No. 5,633,552, issued to Lee et al, a method is disclosed for fabricating a micro-machined pressure transducer having a multilayer silicon nitride thin film cantilever diaphragm. The technique relies on the symmetry of the stress gradient in the two outer layers, and a larger tensile stress (250 MPa) in the second layer to maintain diaphragm flatness.

The diaphragm of the present invention relies on the use of stiffeners to maintain flatness rather than, as the prior art teaches, attempting to balance existing stresses in the various layers of the diaphragm. The patent shows static deflections due to stress of more than 15 microns. Predictable maximum deflection of the diaphragm of the current invention will be approximately 0.5 microns. This is an improvement over the related art by a factor of 30.

In U.S. Pat. No. 5,870,482, issued to Loeppert et al, a cantilever center support diaphragm is illustrated. This patent uses a corrugated structure and a sandwich of two quilted films separated by a thin 2-3 micron sacrificial layer, in order to match the diaphragm compliance to the desired pressure range. It is also desired to counter any curling tendency of the diaphragm. In the current invention the design provides better control over the flatness.

In U.S. Pat. No. 5,146,435, issued to Bernstein, a structure consisting of a single crystal silicon diaphragm supported on its corners by patterned silicon springs is shown. By supporting the diaphragm only at the corners as suggested by Bernstein, it is possible to increase the diaphragm compliance and subsequently, the sensitivity to sound.

While this approach permits a design that is more compliant than the usual approach where the diaphragm is supported entirely around its perimeter, it does not ensure that the stresses in the structure will not result in warpage (if the stress is tensile) and it is quite possible that compressive stresses will result in buckling.

By incorporating stiffeners in the present inventive diaphragm, improved flatness is achieved. The current inventive diaphragm is supported on specially designed torsional springs that have very high stiffness in the transverse direction, but which have well-controlled stiffness in torsion.

SUMMARY OF THE INVENTION

In accordance with the present invention, there is provided an improved diaphragm for a microphone, acoustic sensor, or hearing aid that is not adversely affected by fabrication stresses. It is robust in the sense that it is not affected by fabrication stresses. The diaphragm comprises a rigid flat plate of polysilicon or similar material. The internal supporting structure provides a combination of torsional and translational stiffeners that resemble a number of crossbars. These stiffeners brace and support the diaphragm motion, thus causing it to be very similar in dynamic response to an ideal flat plate operating in a frequency range that extends well beyond the audible. The diaphragm is essentially constrained to pivot about an edge upon which it is supported. The supported end has an overlapping T-section, whose length and cross-sectional dimensions can be adjusted to tune the resonant frequency.

It is an object of this invention to provide an improved diaphragm for a microphone, hearing aid, or acoustic device.

It is another object of the invention to provide a diaphragm for a microphone, hearing aid, or acoustic sensor that is not affected by fabrication stresses.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features an internally stiffened, rigid, flat plate diaphragm for an acoustic device. The internal supporting structure of the diaphragm provides a combination of torsional and translational stiffeners, which resemble a number of crossbars. These stiffeners brace and support the diaphragm motion, thus causing it to be very similar in dynamic response to an ideal flat plate operating in a frequency range that extends well beyond the audible.

Figure 1:
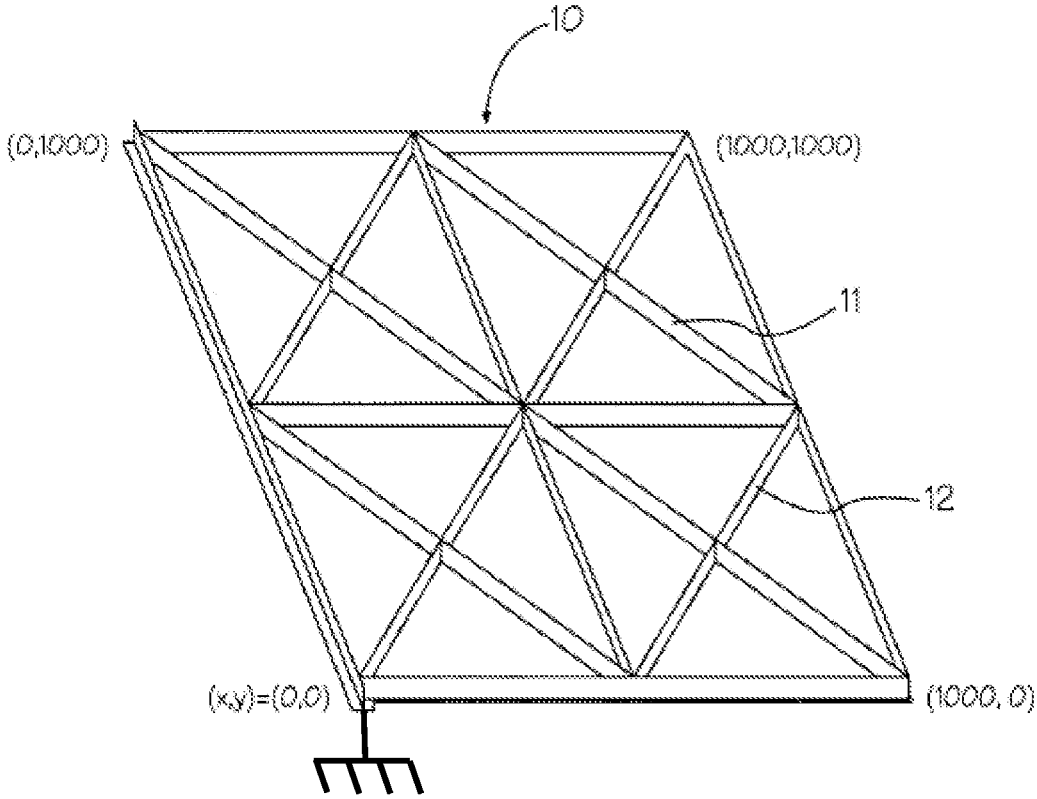
FIG. 1 illustrates a schematic perspective view of the diaphragm with internal support structure, in accordance with this invention.
Figure 2:
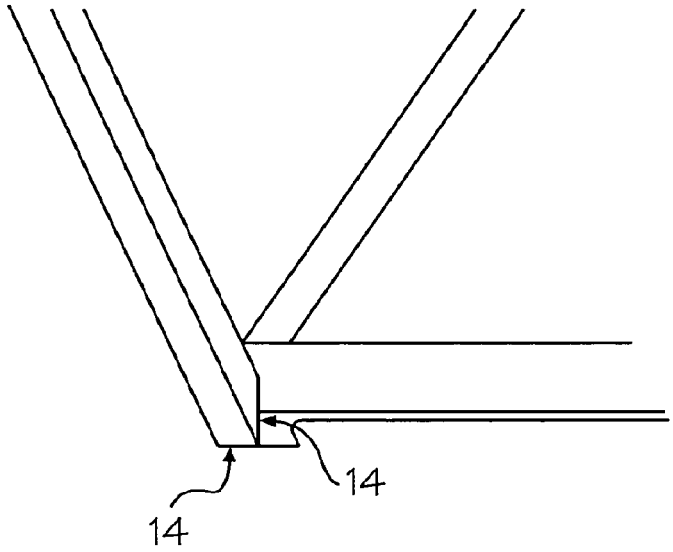
FIG. 2 depicts a schematic, perspective, enlarged top view of a fixed end "T" section of the diaphragm shown in FIG. 1.

Now referring to FIG. 1, a schematic view of a stiffened diaphragm 10 for use in an acoustic device in accordance with the present invention is illustrated. The diaphragm 10 is shaped like a flat rectangular box having internal stiffeners 11 and 12, respectively, forming crossbar bracing members. The crossbar bracing members cause the motion of the diaphragm 10 to approach that of an ideal flat plate. The crossbar members provide the diaphragm 10 with torsional and translational stability. Diaphragm 10 is supported and pivots about a fixed end, "T" section 14, as shown in FIG. 2.

The diaphragm 10 can be used in a microphone, and can be fabricated from polycrystalline silicon or similar material in a microfabrication process. In the microfabrication process, the diaphragm is highly robust and tolerant of fabrication defects. The diaphragm 10 maintains exceptional flatness under the influence of either compressive or tensile stresses that may occur during manufacture. The dynamic response of the diaphragm conforms to an ideal flat plate over a frequency range extending well beyond the audible range. The dynamic characteristics of the diaphragm 10 can be readily tuned without adversely influencing the flatness or ruggedness thereof.

The "T" section 14 can be adjusted in length and cross-section for tuning the resonant frequency. The overall dimensions of the diaphragm 10 are 1 mm by 1 mm. The stiffening crossbars 11 and 12, respectively, can be 4 microns thick and 40 microns tall.

A first mode of vibration is predictably at 24 kHz, and a second mode is at 84 kHz. The second mode is well above the audible frequency, and therefore will not influence the response. Utilization of stiffeners 11 and 12 pushes the unwanted modes of diaphragm 10 into the ultrasonic frequency range so that the response is very similar to an ideal flat plate structure.

Figure 3:
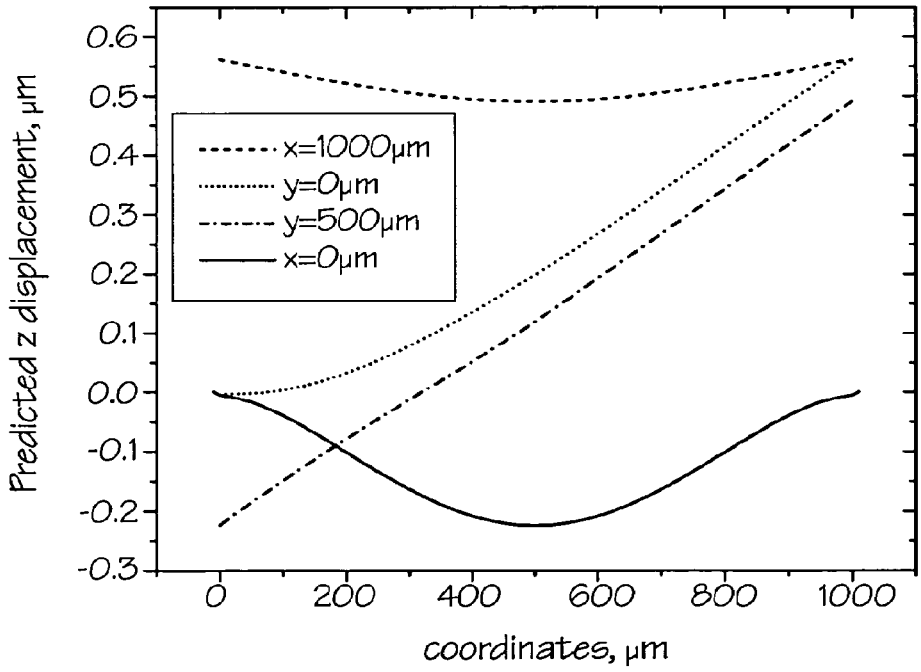
FIG. 3 shows the predicted deformation of the diaphragm due to 40 MPa of compressive stress along four lines across the diaphragm at z=0 and y=0 μm, y=500 μm, x=0 μm, and x=1000 μm.

The diaphragm 10 has high bending rigidity, as shown in FIG. 3. The diaphragm is not prone to buckling when subjected to 40 Mpa of isotropic compressive stress. The identical result, with opposite sign, is obtained with a tensile stress loading.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A microphone, comprising:

an acoustic diaphragm comprising:

a plate having at least one free peripheral edge, at least one torsion support comprising a stiffened edge on one side of the plate comprising a "T"-shaped cross section, and torsional and translational stiffeners distributed on at least one surface of the plate, the torsional and translational stiffeners rigidizing the plate and ensuring flatness, the plate being configured to prevent both buckling and warpage, the microphone being configured to have its dynamic response dominated by a single mode of vibration, which is substantially dependent on at least a set of physical characteristics of the torsion support.

2. The microphone according to claim 1, wherein said torsional and translational stiffeners comprise cross members traversing said plate.

3. The microphone according to claim 1, wherein the at least one torsion support comprises a cantilever torsion support.

4. The microphone according to claim 1, wherein the single mode of vibration which dominates the dynamic response has a frequency of approximately 24 kHz.

5. The microphone according to claim 4, wherein the microphone has a second resonant frequency of approximately 84 kHz.

6. The microphone according to claim 1, wherein a length and dimensions of the "T"-shaped cross section are configured to tune the lowest resonant frequency.

7. The microphone according to claim 1, wherein the plate and torsion support are fabricated from polycrystalline silicon.

8. The microphone according to claim 1, wherein the plate is approximately 2 microns thick.

9. The microphone according to claim 1, wherein the torsional and translational stiffeners comprise crossed rectangular members extending from a flat surface of the plate, which are approximately 4 microns thick and 40 microns tall.

10. The microphone according to claim 1, having a lowest resonant frequency above an audible range of humans approximately 24 kHz.

11. An acoustic diaphragm for a microphone, comprising:

a plate having at least one free peripheral edge and a surface configured with torsional and translational stiffeners to rigidize the plate, ensure flatness and to prevent both buckling and warpage, at least one torsion spring support configured at one edge of the plate comprising a "T"-shaped cross section disposed on an edge of the plate, to support the plate for movement about a torsional axis and configured to substantially control a dynamic response of the plate, the dynamic response being dominated by a single mode of vibration.

12. The acoustic diaphragm according to claim 11, wherein a length and dimensions of the "T"-shaped cross section are configured to tune the lowest resonant frequency.

13. The acoustic diaphragm according to claim 11, wherein the plate is fabricated of polycrystalline silicon.

14. The acoustic diaphragm according to claim 11, wherein the dynamic response comprises a lowest resonant frequency above the audible range.

15. A method of operating a microphone, comprising:

providing an acoustic diaphragm comprising a plate having at least one free peripheral edge comprising a "T"-shaped cross section disposed on an edge of the plate, at least one torsion support, and torsional and translational stiffeners distributed on at least one surface of the plate, the torsional and translational stiffeners rigidizing the plate and ensuring flatness, the plate being configured to prevent both buckling and warpage, the microphone being configured to have its dynamic response dominated by a single mode of vibration, which is substantially dependent on at least a set of physical characteristics of the torsion support; and subjecting the microphone to acoustic vibrations to induce a movement of the plate corresponding to the acoustic vibrations, wherein the plate has a dynamic response corresponding to an ideal flat plate operating in a frequency range that extends beyond an audible range.

16. The method according to claim 15 wherein said torsional and translational stiffeners comprise cross members traversing said rigid plate-shaped member, and the at least one torsion support comprises a cantilever torsion support comprising a stiffened edge on one side of the plate.

17. The method according to claim 16, wherein a length and dimensions of the "T"-shaped cross section are configured to tune the lowest resonant frequency.

18. The method according to claim 15, wherein the plate and torsion support are fabricated from polycrystalline silicon, the plate being approximately 2 microns thick, and the torsional and translational stiffeners comprise crossed rectangular members extending from a flat surface of the plate, which are approximately 4 microns thick and 40 microns tall.

19. The method according to claim 15, having a lowest resonant frequency of the dynamic response of approximately 24 kHz.

20. The method according to claim 15, having a second resonant frequency of the dynamic response of approximately 84 kHz.

* * * * *

UNITED STATES PATENT AND TRADEMARK OFFICE

CERTIFICATE OF CORRECTION

PATENT NO. : 8,582,795 B2
APPLICATION NO. : 13/013812
DATED : November 12, 2013
INVENTOR(S) : Ronald N. Miles It is certified that error appears in the above-identified patent and that said Letters Patent is hereby corrected as shown below:

In the Specification

Column 1, line 4 after the title, the following paragraph should be inserted:

-- STATEMENT OF GOVERNMENT INTEREST

This invention was made with Government support under award DAAD17-00-C-0149 awarded by the ARMY/ARL. The Government has certain rights in the invention. --

Signed and Sealed this
Twenty-ninth Day of April, 2014

Michelle K. Lee

Michelle K. Lee
*Deputy Director of the United States Patent and Trademark Office*